US008052391B1

(12) United States Patent
Brown

(10) Patent No.: US 8,052,391 B1
(45) Date of Patent: Nov. 8, 2011

(54) HIGH TEMPERATURE TURBINE ROTOR BLADE

(75) Inventor: Wesley D Brown, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 402 days.

(21) Appl. No.: 12/410,489

(22) Filed: Mar. 25, 2009

(51) Int. Cl.
*F01D 5/18* (2006.01)

(52) U.S. Cl. ..... 416/97 R; 416/223 A; 416/233; 416/241 R

(58) Field of Classification Search ..... 415/115, 415/177; 416/96 A, 96 R, 97 R, 144, 216, 416/217, 219 R, 223 A, 224, 226, 229 A, 416/233, 241 A, 241 R
See application file for complete search history.

(56) References Cited

U.S. PATENT DOCUMENTS 3,867,068 A * 2/1975 Corsmeier et al. ..... 416/97 R
3,942,581 A * 3/1976 Sawyer ..... 164/122.1
4,010,531 A * 3/1977 Andersen et al. ..... 29/889.721
4,136,516 A * 1/1979 Corsmeier ..... 60/39.091
4,971,641 A * 11/1990 Nelson et al. ..... 156/64
5,129,787 A * 7/1992 Violette et al. ..... 416/226
5,240,376 A * 8/1993 Velicki ..... 416/229 A
5,314,309 A * 5/1994 Blakeley et al. ..... 416/226
6,139,278 A * 10/2000 Mowbray et al. ..... 416/229 A
6,224,339 B1 * 5/2001 Rhodes et al. ..... 416/224
6,305,905 B1 * 10/2001 Nagle et al. ..... 416/204 R
6,533,547 B2 * 3/2003 Anding et al. ..... 416/97 R
6,726,444 B2 * 4/2004 Zhao et al. ..... 415/115
7,125,225 B2 * 10/2006 Surace et al. ..... 416/96 R
7,258,528 B2 * 8/2007 Trindade et al. ..... 416/96 A
7,303,376 B2 * 12/2007 Liang ..... 416/96 R
7,311,497 B2 * 12/2007 Sharma et al. ..... 416/97 A
7,497,655 B1 * 3/2009 Liang ..... 415/1
7,549,844 B2 * 6/2009 Liang ..... 416/97 R
8,007,242 B1 * 8/2011 Brown et al. ..... 416/224

* cited by examiner

*Primary Examiner* — Michael Lebentritt
(74) *Attorney, Agent, or Firm* — John Ryznic

(57) ABSTRACT

A turbine rotor blade made from the spar and shell construction in which the shell is a thin wall shell made from a high temperature resistant material that is formed by a wire EDM process, and where the shell is secured to the spar using a retainer that is poured into retainer occupying spaces formed in the shell and the spar, and then hardened to form a rigid retainer to secure the shell to the spar. The spar and the shell both have grooves facing each other to form a retainer groove. A retaining material, such as a liquid or a powdered metal, is poured into the grooves and hardened to form a retainer to secure the shell to the spar. The retaining material also forms a seal on the top of the spar and between the spar and shell.

8 Claims, 2 Drawing Sheets

HIGH TEMPERATURE TURBINE ROTOR BLADE

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade made from a spar and shell construction.

2. Description of the Related Art Including Information Disclosed Under 37 CFR 1.97 and 1.98

A gas turbine engine, such as an industrial gas turbine (IGT) engine, passes a hot gas flow through a turbine having a number of stages or rows of rotor blades and stator vanes to extract energy and drive the rotor shaft to produce electric power. It is well known that the efficiency of the engine can be increased by passing a higher temperature gas through the turbine. However, the maximum temperature is related to the material properties and the cooling capability of the first stages blades and vanes.

Prior art turbine airfoils are produced from high temperature resistant materials such as Inconnel and other nickel based super-alloys in which the airfoils are cast using the well known investment casting process. These materials have relatively high temperature resistance. However, a thin walled airfoil cannot be produced using the investment casting process because the airfoil wall is too thin for casting of the alloy may not be castable at all. A thin walled airfoil would be ideal for improved cooling capability since the heat transfer rate through the thin wall would be extremely high. In a thin walled airfoil, the outer airfoil surface temperature would be about the same as the inner airfoil wall temperature because of the high heat transfer rate.

Exotic high temperature resistant materials such as Tungsten, Molybdenum and Columbium have higher melting temperature than the nickel based super-alloys currently used in turbine airfoils. However, tungsten and molybdenum cannot be cast because of their high melting temperatures, and especially cannot be cast into a thin wall airfoil because the material cannot flow within the small space formed within the mold.

Rotor blades must be replaced or repaired on a regular basis in order to maintain high levels of efficiency in the operation of an engine like the IGT engine used for electrical power generation. Thus, it would be beneficial to provide for a rotor blade that will allow for quick and easy replacement of any damaged or worn part of the blade so that the new blade can be installed. Also, it would be beneficial for the blade to be easily refurbished or brought back to like new condition without having to machine or weld or use other metal working processes to fix the blade.

Thus, a new and improved turbine blade has been proposed in which a high temperature resistant exotic material such as tungsten or molybdenum is used to form a thin walled shell for the airfoil that is secured to a spar that forms a rigid support structure for the shell. The shell is formed from tungsten or molybdenum using an EDM (electric discharge machining) process such as wire EDM to cut the metallic material into the shell shape. The shell in then secured to the spar to form a turbine blade or vane which can be used under much higher operating temperatures than the investment cast nickel super-alloy blade or vane.

BRIEF SUMMARY OF THE INVENTION

It is an object of the present invention to provide for a high temperature turbine rotor blade with a thermally free platform.

It is another object of the present invention to provide for a spar and shell type rotor blade in which the shell is which the radial load capability for the shell is around 25 to 30 Klbs.

It is another object of the present invention to provide for a spar and shell type rotor blade with an effective seal at the tip.

The above objectives and more are achieved with the turbine rotor blade of the present invention which includes a spar and shell construction in which the spar is secured to a spar by a bicast retainer that also forms the blade tip. The shell and the spar form adjacent and opposite retainer forming grooves in which a liquid material is poured that hardens to form the blade tip as well as retainers that secure the shell against radial displacement to the spar. The shell is made from a single crystal material of form Molybdenum in order to provide for a high temperature resistance as well as light weight to limit stress levels due to rotation of the blade.

In a second embodiment, a number of pins are inserted through aligned holes in both the spar and the shell in the tip region to secure the shell to the spar. The pins extend in a direction substantially parallel to the blade tip, and in which the pins are bonded or deformed to prevent removal.

DETAILED DESCRIPTION OF THE INVENTION

The spar and shell rotor blade of the present invention is for use in an industrial gas turbine engine in the first or second stage of the turbine. These blades are much larger than those used in as aero engine and therefore the weight of the shell would be an important design factor in the blade assembly. However, the bicast spar and shell rotor blade can be used in an aero engine. The turbine rotor blade is made with a spar that extends from a platform and root section all formed as a single piece or that can be formed as multiple pieces, and with a shell secured to the spar to form the airfoil portion of the blade. A tip cap can be secured to the spar tip end to form the blade tip for the blade assembly.

The shell is formed using a wire EDM process with the shell made from a high temperature exotic material that can withstand higher temperatures than the prior art turbine blades made from the investment casting process. The preferred metallic material for the present invention is Molybdenum because of the high strength capability and high temperature resistance. Tungsten is considered for use in a rotor blade, but because tungsten is very dense compared to Molybdenum it is not useful for a rotor blade because of the high centrifugal loads applied to the spar to retain the much heavier tungsten shell to the spar. Tungsten would be good for a spar and shell stator vane which does not rotate. Columbium or niobium is also considered for use as the shell material for a rotor blade.

Figure 1:
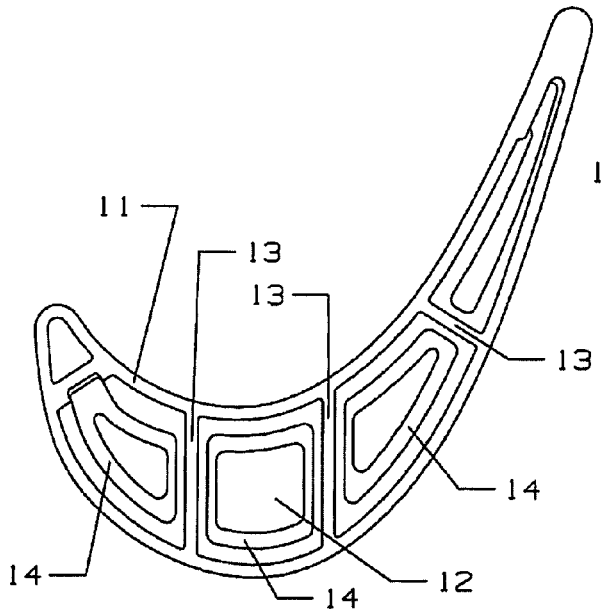
FIG. 1 shows a cross section top view of the spar and shell rotor blade of the present invention.

The rotor blade 10 with the spar and shell construction of the present invention includes a shell 11 having an airfoil cross sectional shape with a leading edge and a trailing edge and with a pressure side wall and a suction side wall extending between the two edges as seen in FIG. 1. The shell is made from a high temperature resistant material such as Molybdenum or Columbium that cannot be cast using the prior art investment casting process into a thin wall. The shell is made using a wire EDM process in order to form the shell as a thin wall shell that will provide high heat transfer rates so that the metal temperature will remain relatively low. The shell can also be made from a single crystal material. The shell 11 also includes ribs 13 that extend from the pressure side wall to the suction side wall to provide support.

The spar 12 forms a support structure for the thin walled shell 11 and include a platform and a root that forms the remaining parts of the turbine blade. The spar 12 includes a number of radial projecting portions 14 that form retaining surfaces for the shell 11. The radial extending portions 14 of the spar 12 fit between the ribs 13 of the shell 11. The platform and root and the spar can be formed from a single piece or from several pieces bonded together. Also, the spar can be formed from a different material than the shell because the spar is not exposed to the higher temperatures that the shell 11 is. The spar along with the integral root and platform can be cast as a single piece using the well known investment casting process and then details can be machined into the spar.

Figure 2:
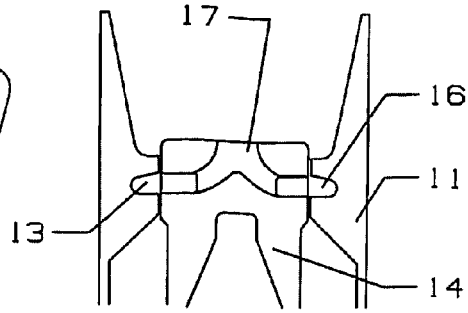
FIG. 2 shows a cross section front view of the spar and shell with the cavities for pouring the liquid retainer material.
Figure 3:
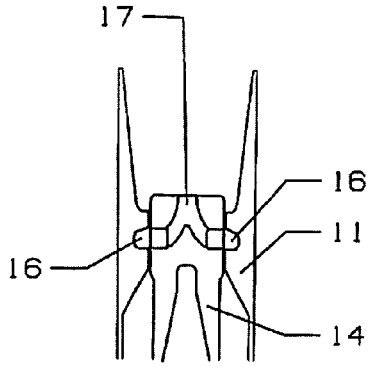
FIG. 3 shows a cross section front view of another section of the spar and shell like that is FIG. 2.

FIG. 2 shows a cross section through a cut of the spar 12 and shell 11 in an assembled position with a groove 16 on the inside surface of the shell facing inward that forms part of a retainer groove 16 for the blade. the grooves within the shell 11 are formed within a thicker section near the top end of the shell 11 than the thin wall sections. The spar 12 includes a pouring cavity 17 on the top end that separates into two channels each ending at the grooves 16 formed in the shell. FIG. 3 shows a similar cut section for the spar and shell but at a narrower section. This section also includes grooves within the shell and pouring cavity within the spar as in FIG. 2. FIG. 2 is in the wider radial projection 14 of the spar 12 while FIG. 3 is in a narrower projection 14 such as the leading edge projection or the trailing edge projection 14.

Figure 4:
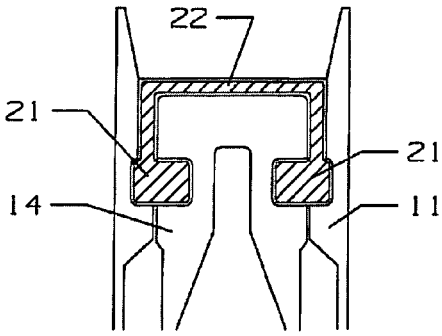
FIG. 4 shows a cross section front view of a wide section of the spar and shell with the hardened retainer material occupying the cavities and forming the tip cap.
Figure 5:
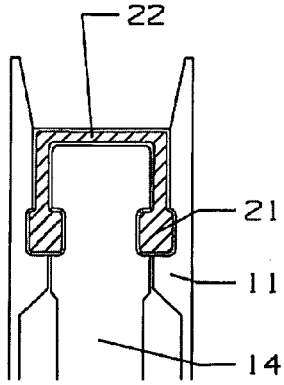
FIG. 5 shows a cross section front view of a middle section of the spar and shell with the hardened retainer material forming the tip cap.
Figure 6:
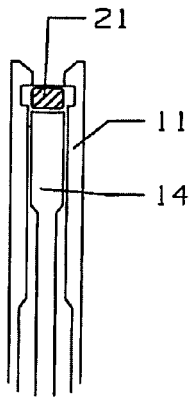
FIG. 6 shows a cross section front view of a narrow section of the spar and shell with the hardened retainer material forming the tip cap.

The shell 11 is secured to the spar 12 by pouring a liquid metal or a powdered metal material into the grooves to form a hardened retainer. FIG. 4 shows a cut section of the spar 12 and shell 11 with a retainer 21 that has hardened within the pouring channel 17 of the spar, the two diverging passages formed in the spar 12 and the grooves 16 formed on the inner side of the shell 11. The rectangular shaped retainers in the grooves 16 form a strong retainer secure the shell 11 to the spar 12 against the high radial loads due to the centrifugal forces when the blade rotates. A stop-off material can be used to prevent the retaining material from bonding to one of the parts so that removal of the retainer material later when an old shell is replaced can be easier. A stop-off material is a coating applied to the metallic surface in which the retaining material will not bond to. FIG. 5 shows a middle section of the spar 12 and shell assembly with the retainer 21 formed within the grooves and the pouring spaces. FIG. 6 shows a section in the trailing edge that is relatively narrow compared to the other sections in FIGS. 4 and 5. As seen in all of FIGS. 4 through 6, the retainer 21 does not form a retainer but forms a seal 22 for the blade top end.

The retainer 21 can be formed as a bicast material that is a liquid metal with a lower melting temperature than the spar and shell so that the molten metal does not melt either the shell or spar during the pouring process. Also, the retainer 21 can be made from a powdered metallic material that is then hardened by cooking the assembly. Preferably, the retainer 21 is formed from a high temperature alloy since the retainer also forms the seal 22 for the blade top between the shell 11 and the spar 12. This surface would be exposed to any hot gas flow that would leak across the blade tip during the engine operation. With the shell 11 sticking up above the top end of the spar 12, a squealer pocket is formed for the blade tip and the retainer that forms the seal 22 then also forms the squealer pocket floor.

Figure 7:
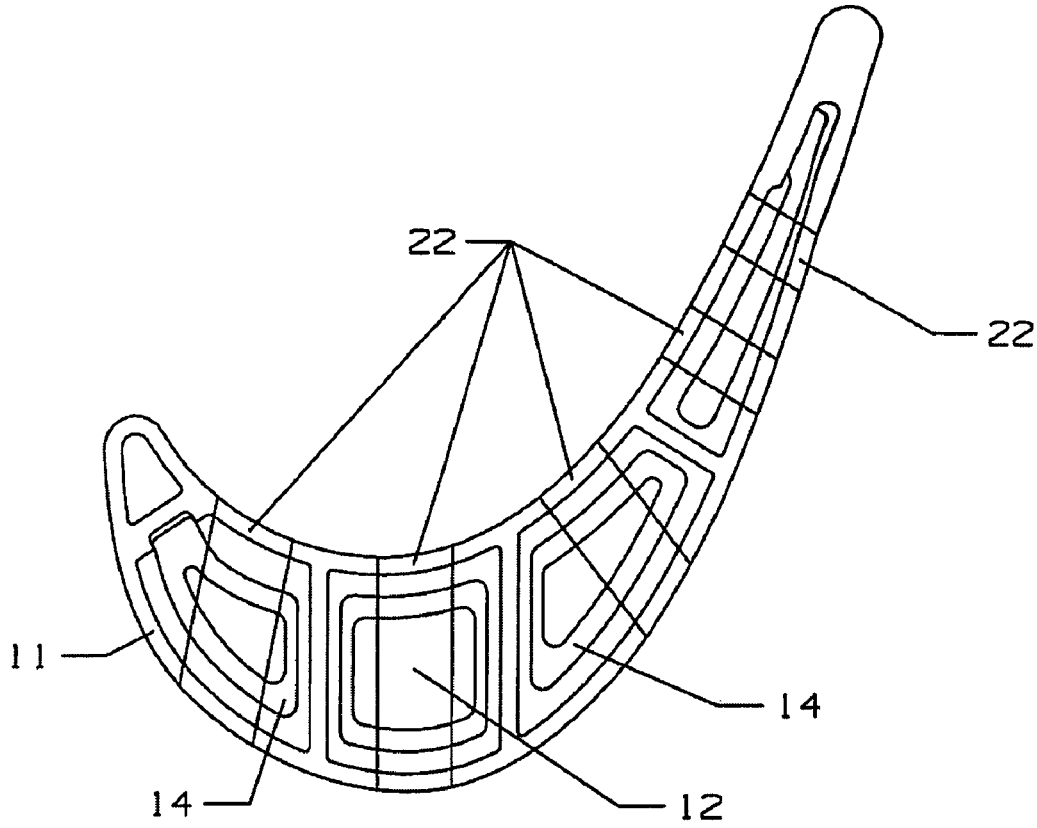
FIG. 7 shows a cross section top view of a second embodiment of the present invention with pins used to secure the shell to the spar.
Figure 8:
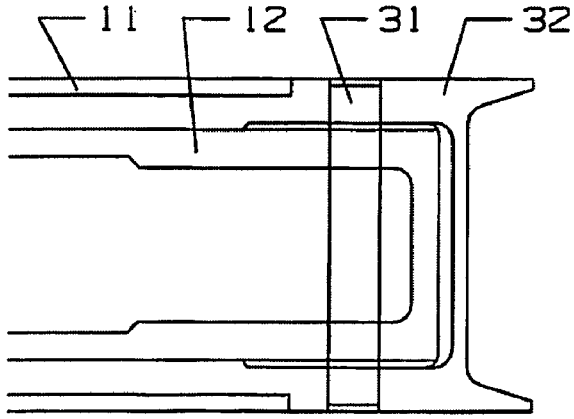
FIG. 8 shows a cross section side view of a pin securing the shell to the spar of the second embodiment of FIG. 7.

FIG. 7 shows a second embodiment of the spar and shell turbine blade of the present invention in which the shell 11 is secured to the spar by pins that extend from the side walls and through the spar parallel to the chordwise plane of the blade. FIG. 7 shows a pin 22 for each of the radial projections 14 of the spar 12. FIG. 8 shows a cross section with one of the pins 31 securing the shell 11 to the spar 12 but through a tip cap 32. The tip cap 32 includes a stepped portion in which the shell 11 fits to form a smooth outer airfoil surface with the tip cap 32. The pins 31 are formed from a high strength material. The tip capo 32 is made from a high temperature resistant material such as Molybdenum or Columbium or a single crystal material because the tip cap is exposed to the high temperature gas flow that leaks across the blade tip. The tip cap 32 is needed in this embodiment because the shell would cover up and holes for the pins within the spar 12. With the pin inserted into place, the pin 31 is then bonded to or deformed with respect to the tip cap 32 to prevent it from loosening. Other forms of retaining the pin 31 within the holes can be sued without departing from the spirit or scope of the invention.

I claim the following:

1. A turbine rotor blade for a gas turbine engine comprising:

a spar having a radial extending projection with a top end;

an outward facing groove opening in the radial extending projection and located near the top end;

a shell having an airfoil shape and having a thin wall;

the shell having a thicker section near the top end with an inward facing groove;

the groove on the shell and the groove in the spar forming a retainer groove; and, a retainer material occupying the space within the retainer groove to secure the shell to the spar and to form a seal on the top end of the radial extending projection.

2. The turbine rotor blade of claim 1, and further comprising:

the top end of the radial extending projection includes an opening of a channel in which a retainer material can be poured into the retainer groove.

3. The turbine rotor blade of claim 1, and further comprising:

the shell and the radial extending projection both include grooves on the pressure side and the suction side.

4. The turbine rotor blade of claim 3, and further comprising:

the top end of the radial extending projection includes an opening of a channel that splits into two channels in which a retainer material can be poured into the pressure side and the suction side retainer grooves.

5. The turbine rotor blade of claim 1, and further comprising:

the shell is made of Molybdenum or Columbium or a single crystal material.

6. The turbine rotor blade of claim 1, and further comprising:

the retainer is made from a high temperature resistant alloy having a melting temperature lower than the spar material so that the surface of the spar material does not melt when the retainer material is poured in a molten state into the retainer groove.

7. The turbine rotor blade of claim 1, and further comprising:

the shell walls extend above the top end of the spar to form a squealer pocket for the blade tip; and, the retainer forms a seal for the squealer pocket floor.

8. The turbine rotor blade of claim 1, and further comprising:

the spar includes a plurality of radial extending projections each with an outward facing groove;

the shell includes inward facing grooves to form retainer grooves with the spar; and, a retainer occupying the retainer grooves formed within the spar and the shell to secure the shell to the spar in a plurality of locations.

* * * * *